United States Patent [19]

Lowery

[11] Patent Number: 4,477,058

[45] Date of Patent: Oct. 16, 1984

[54] PLASTIC FENCE

[76] Inventor: A. J. Lowery, 867 Sandell, White Settlement, Tex. 76108

[21] Appl. No.: 495,049

[22] Filed: May 16, 1983

[51] Int. Cl.[3] ..... E04H 17/14

[52] U.S. Cl. ..... 256/19; 256/67

[58] Field of Search ..... 256/1, 19, 66, 65, 67, 256/60; 47/33; 403/400

[56] References Cited

U.S. PATENT DOCUMENTS

| | | | |
|---|---|---|---|
| 2,545,845 | 3/1951 | DuBatto et al. | 256/19 |
| 3,067,985 | 12/1962 | Cusack | 256/67 X |
| 3,545,127 | 12/1970 | Jensen | 256/32 X |
| 3,768,780 | 10/1973 | Cowles et al. | 256/32 X |
| 3,865,309 | 2/1975 | Greenhalgh | 256/1 X |
| 4,007,919 | 2/1977 | Totten | 256/65 X |
| 4,324,388 | 4/1982 | Klaser | 256/66 X |

FOREIGN PATENT DOCUMENTS

| | | | |
|---|---|---|---|
| 245785 | 3/1966 | Austria | 403/400 |

*Primary Examiner*—Andrew V. Kundrat

*Attorney, Agent, or Firm*—James E. Bradley

[57] ABSTRACT

A fence is constructed of plastic components. The fence has a tubular support that is anchored in the ground. A post slides over the support and extends upwardly. Plastic rails interconnect the posts. Each rail has protruding pegs extending out from one side. Plastic fence boards have holes formed in one side for snapping onto the pegs to secure the fence boards. Some of the holes are vertical slots to allow the fence boards to be positioned at various vertical heights. A plastic strip is placed in contact with the ground between the posts. The strip has an upwardly facing channel for receiving the lower edges of the fence boards.

5 Claims, 5 Drawing Figures

PLASTIC FENCE

BACKGROUND OF THE INVENTION

1. Field of the Invention

This invention relates in general to fences, and in particular to a fence constructed with plastic components.

2. Description of the Prior Art

Most residential fences fall into two types, chain link or wood. The chain link fence is a long lasting, inexpensive fence constructed of metal. However, it is not particularly attractive. Also, it does not block visibility to provide privacy. Wood fences usually have wooden posts, rails, and fence boards nailed to the rails. Although they are constructed of weather resistant wood, which often is chemically treated, still the fence will weather. The appearance declines and the wood will deteriorate. Also, the material cost is expensive.

There have been some proposals in the patented art to provide fences constructed of plastic, which would be long lasting, maintenance free, and having an attractive appearance. These patents include U.S. Pat. Nos. 4,124,198, issued Nov. 7, 1978, Wong; 3,700,213, issued Oct. 24, 1972, Blease; and 4,260,138 issued Apr. 7, 1981, Freer.

SUMMARY OF THE INVENTION

In this invention in the preferred embodiment, the post, rails and fence boards are all constructed of plastic. The posts probably are mounted to a support which has a sharp pointed anchor for driving into the ground. The post slides over the support and telescopingly extends upwardly. The rails are connected to the posts and have pegs protruding outwardly. The fence boards have mating holes which snap over the pegs to hold the fence boards in place. At least some of the fence boards will have holes that are longitudinal slots. This allows the boards to be adjusted vertically for uneven terrain.

A guard strip is adapted to be placed between the posts in contact with the ground. The guard strip is a flexible plastic strip that has an upwardly facing channel in its center for receiving and supporting the lower edge of the fence boards. The guard strip has guard portions that extend laterally outward from the channel and contact the ground for preventing grass from growing in contact with the fencing. The channel provides support for the lower edges of the fence boards.

DESCRIPTION OF THE PREFERRED EMBODIMENT

Figure 1:
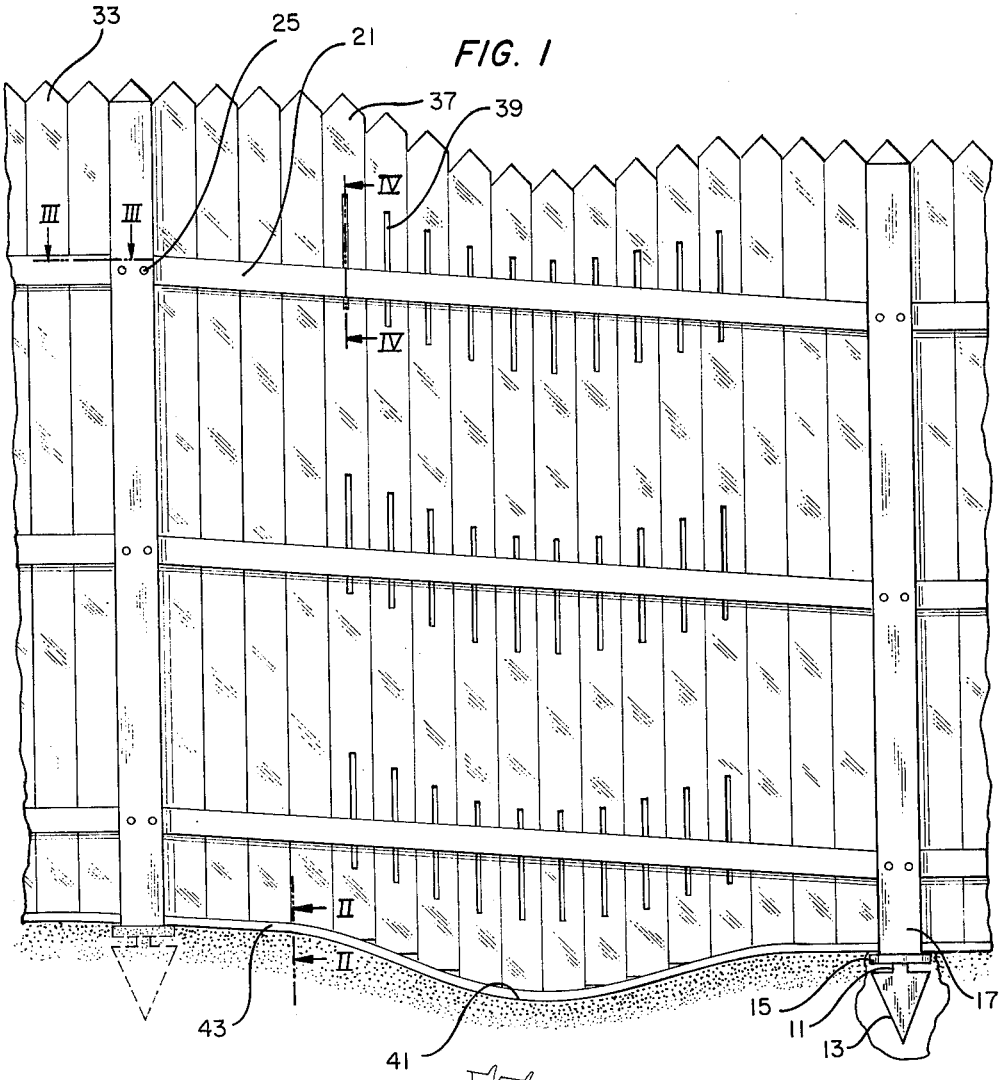
FIG. 1 is a side view of a fence constructed in accordance with this invention.
Figure 5:
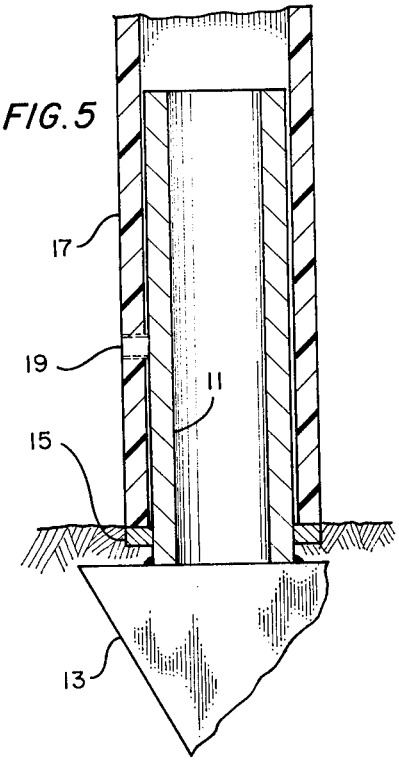
FIG. 5 is a partial-vertical sectional view of one of the fence posts of the fence of FIG. 1.

Referring to FIG. 1, part of a fence constructed in accordance with this invention is shown from one side. The fence includes a support 11, which could be of a very hard plastic, or of metal. Suppport 11, as shown also in FIG. 5, is a square tube that protrudes above the groundfor a selected distance, such as about 18 inches. The support 11 has secured to its bottom a triangular anchor 13 that has a sharp tip and is basically a flat plate of metal or plastic. Anchor 13 is used for driving the support 11 into the ground and for anchoring the support in an upright position. A flange 15 extends around the support immediately above anchor 13. A telescoping driving tube (not shown) of a heavy metal will slide over the support 11 to drive the support 11 into the ground. The driving tube is reciprocated to hammer blows against the flange 15.

Figure 3:
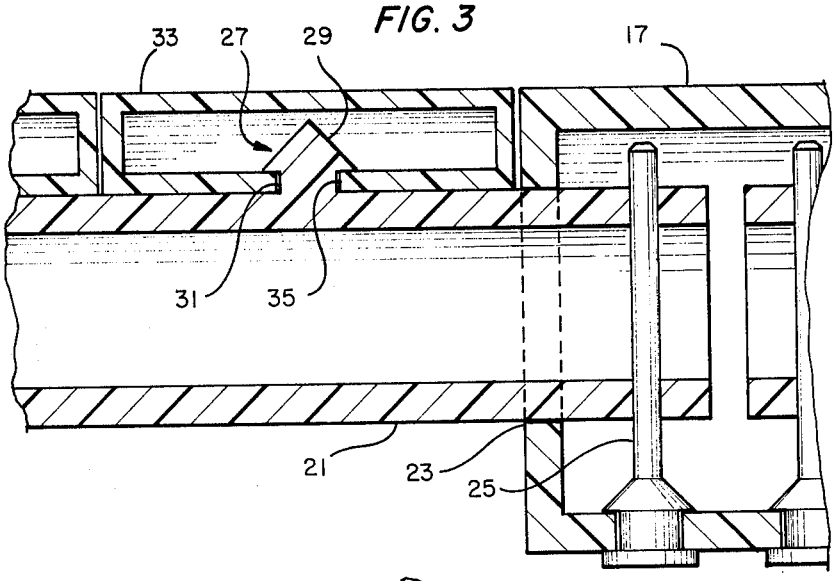
FIG. 3 is a sectional view of the fence of FIG. 1, taken along the line III—III of FIG. 1.

A post 17 of a heavy duty plastic will slide telescoping and closely over support 11. Post 17 extends upwardly for the desired height of the fence, and is preferably a rectangular tube, as shown in FIG. 3. A set screw (FIG. 5) is used to secure the post 17 to the support 11.

In the preferred embodiment, three horizontal rails 21 extend between the post. Rails 21 are parallel to each other and generally perpendicular to the post 17. As shown in FIG. 3, the end of each rail 21 extends into a square aperture 23 provided on each side of post 17. There will be three apertures 23 on each side, all spaced-apart the desired distance. A pin 25 extends through post 17 and through holes provided in the end of rail 21 to secure the rails 21 to the post 17. Pins 25 are preferably of metal and have enlarged heads to press fit within the plastic post 17.

As shown in FIG's. 3 and 4, each rail 21 has a plurality of pegs 27. Pegs 27 are spaced-apart along one side of each rail 21. Each peg 27 has an enlarged conical pointed head 29, and a reduced diameter cylindrical neck 31.

A plurality of fence boards 33 are adapted to be secured in side-by-side contact along rails 21, generally in a single plane, and parallel with the posts 17. Fence boards 33 each have three holes 35 for registering with one of the pegs 27 on each rail 21. As shown in FIG. 3, the hole 35 has a diameter that is less than the dimension of the head 29 but greater than the diameter of the neck 31. Also, the fence board 33 is plastic and hollow. This allows the fence board 33 to be pressed tightly against the rails 21. The hole 35 and head 29 will deform to allow the fence board 33 to be snapped into place. This rigidly secures the fence board 33 to the rails 21.

Figure 4:
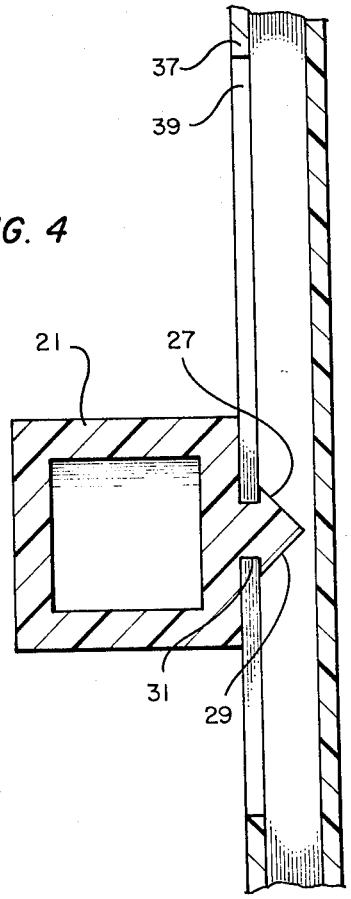
FIG. 4 is a sectional view of the fence of FIG. 1, taken along the line IV—IV.

As shown in FIG. 1, some of the fencing comprises fence boards 37, which are identical to fence boards 33, except that the holes for the pegs 27 are elongated, vertical slots 39. These slots extend parallel with the lengths of the fence boards 37 and enable the fence boards 37 to be positioned at different vertical positions with respect to the rail. FIG. 4 shows one of the pegs 27 snapped into place within one of the slots 39. The width of the slots 39 is less than the distance across the head 29 of the pegs 27 and greater than the diameter of neck 31 to retain the fence boards 37. Retaining fence boards 37, but allowing them to slide vertically by the use of the slots 39, allows one to accommodate for uneven terrain, as indicated by the recessed area 41, FIG. 1.

Figure 2:
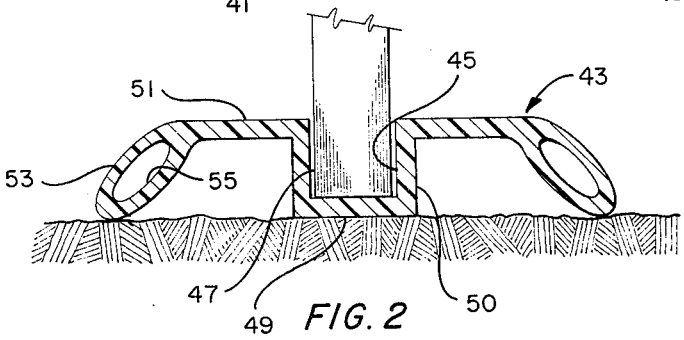
FIG. 2 is a sectional view of the fence of FIG. 1, taken along the line II—II of FIG. 1.

Referring to FIG's. 1 and 2, a guard strip 43 is located below the lower edges 47 of the fence boards 33 and 37 and extends the length between two of the posts 17. Guard strip 43, as shown in FIG. 2, has an upwardly facing channel 45 that extends continuously the full length of the strip 43. Channel 45 has a width that is slightly greater than the thickness of the fence boards 33 and 37 for closely receiving the lower edge 47 of each fence board 33 and 37. Channel 45 has a base 49 that is in contact with the ground. The sidewalls 50 of channel 45 extend upwardly from base 49. At the upper corners, a guard portion 51 extends laterally outward in both directions. Guard portion 51 is a flat portion that is perpendicular to the sidewalls 50 and located above the ground. An outer edge portion 53 extends downwardly from each guard portion 51 and contacts the ground. The outer edge portion in the preferred embodiment has longitudinal holes 55 for reducing the amount of plastic required.

To erect the fence, one first drives the anchors 13 of supports 11 into the ground. Rails 21 are secured to posts 17 by pins 25, and posts 17 are placed over supports 11 and secured by set screws 19. Guard strip 43 is placed between posts 17. Fence boards 33 are snapped onto pegs 27 of rails 21, with their lower edges in channel 45 of guard strip 43. If uneven terrain exists, some fence boards 27 may be used, with slots 39 snapped onto pegs 27.

The invention has significant advantages. The guard strip both retains the lower edge of the fencing, while at the same time preventing grass from growing up in contact with the fencing. The support for the plastic fence posts allows the fence to be erected without digging holes and using concrete. The pegs on the rails allow easy installation of the fence boards. The slots in some of the fence boards accommodate uneven terrain.

While the invention has been shown in only one of its forms, it should be apparent to those skilled in the art that it is not so limited but is susceptible to various changes without departing from the scope of the invention.

I claim:

1. An improved fence, comprising in combination:

a plurality of posts adapted to be anchored in the ground;

at least two vertically spaced-apart rails extending transversely between the posts;

a plurality of fence boards, each having holes formed therein; and fastening means extending through the holes in the fence boards for fastening the fence boards to the rail;

at least some of the holes being elongated vertical slots spaced apart sufficiently to allow the fence boards to be moved vertically with respect to the rails to accommodate uneven terrain.

2. The fence according to claim 1 wherein the fence boards and rails are constructed of plastic, and wherein the fence boards are hollow, with the holes extending through only one sidewall of the fence boards.

3. The fence according to claim 2 wherein the fastening mens comprises a plurality of plastic pegs integrally formed with and protruding from the rails, each peg having a reduced diameter neck of lesser diameter than the width of the hole, and an enlarged diameter head of the width larger than the hole.

4. An improved fence, comprising in combination:

a tubular support adapted to be anchored in the ground in an upright position;

a hollow plastic post adapted to be closely received over the support and secured thereto, the post extending upwardly from the support;

a plurality of plastic rails extending transversely between the posts and connected to the posts;

a plurality of hollow, plastic fence boards, each having holes formed therein; and fastening means extending through the holes in the fence boards for fastening the fence boards to the rails, at least some of the holes being elongated vertically and spaced-apart sufficiently to allow the fence boards to be moved vertically with respect to the rails to accommodate uneven terrain.

5. An improved fence, comprising in combination:

a tubular support adapted to be anchored in the ground in an upright position;

a hollow plastic post adapted to be closely received over the support and secured thereto, the post extending upwardly from the support;

a plurality of plastic rails extending transversely between the posts and connected to the posts, the rails each having a plurality of plastic pegs protruding from one side;

a plurality of hollow, plastic fence boards, each having holes formed one one side for snapping the fence boards onto the pegs; and a flexible plastic strip adapted to be placed between the posts in contact with the ground, the strip having an upwardly facing channel for closely receiving the lower edges of the fence boards;

the support having a depending sharp pointed anchor for driving into the ground to anchor the support;

at least some of the holes of the fence boards being vertically elongated slots for allowing the fence boards to be positioned at various vertical positions with respect to the rails to accommodate uneven terrain.

* * * * *